US009072397B2

(12) United States Patent
Clifton

(10) Patent No.: US 9,072,397 B2
(45) Date of Patent: Jul. 7, 2015

(54) COMPRESSION SOCK AID

(71) Applicant: Garry Clifton, Park City, UT (US)

(72) Inventor: Garry Clifton, Park City, UT (US)

( * ) Notice: Subject to any disclaimer, the term of this patent is extended or adjusted under 35 U.S.C. 154(b) by 0 days.

(21) Appl. No.: 14/320,957

(22) Filed: Jul. 1, 2014

(65) Prior Publication Data

US 2015/0136815 A1 May 21, 2015

Related U.S. Application Data

(60) Provisional application No. 61/906,729, filed on Nov. 20, 2013.

(51) Int. Cl.
*A47G 25/90* (2006.01)
*A41B 11/00* (2006.01)

(52) U.S. Cl.
CPC ..... *A47G 25/905* (2013.01); *A41B 11/00* (2013.01); *A47G 25/90* (2013.01)

(58) Field of Classification Search
CPC ... A47G 25/90; A47G 25/905; A47G 25/907; A47G 25/908; A41B 11/00; A41B 11/02
USPC ..... 223/111, 112, 118, 119; D2/641, 642; 2/239, 240
See application file for complete search history.

(56) References Cited

U.S. PATENT DOCUMENTS

| | | | | |
|---|---|---|---|---|
| 129,175 | A | 7/1872 | Ettssell | |
| 2,796,207 | A | 6/1957 | Young | |
| 2,828,057 | A | 3/1958 | Maclauchlan | |
| 3,310,209 | A | 3/1967 | Clauss | |
| 3,401,856 | A | 9/1968 | Berlin | |
| 3,993,228 | A * | 11/1976 | Fuhr | 223/111 |
| 5,513,783 | A * | 5/1996 | White | 223/112 |
| 5,799,844 | A | 9/1998 | James | |
| 5,826,761 | A * | 10/1998 | Basaj | 223/112 |
| 5,894,970 | A * | 4/1999 | Belkin et al. | 223/112 |
| 6,065,654 | A * | 5/2000 | Evensen | 223/113 |
| 7,234,616 | B2 | 6/2007 | Thom et al. | |
| 8,919,620 | B2 * | 12/2014 | Taylor et al. | 223/111 |
| 2004/0031806 | A1 * | 2/2004 | Jackson | 220/754 |
| 2006/0076372 | A1 * | 4/2006 | Delamare | 223/111 |

* cited by examiner

*Primary Examiner* — Ismael Izaguirre
(74) *Attorney, Agent, or Firm* — Daniel Boudwin; Global Intellectual Property Agency LLC

(57) ABSTRACT

Disclosed is a compression sock aid device having a left and right double paneled structure hingedly connected to one another, wherein a spring member provides outward bias to facilitate opening of the device and the spreading of sock material placed thereover. Rope handles with gripping portions and associated hook notch closure means are provided, along with friction pads and thumb grips to facilitate the application of compression stockings and tight fitting hosiery onto the leg of the wearer. The hosiery is placed over the device while the spring member and hinged connection enable the opening of the hosiery placed thereon. The device is secured using the rope handle that includes a fastening ball, wherein the rope handle is placed into an opposing hook notch to resist the outward bias of the spring member. The inner panels support the hosiery away from the user's skin while the inner panels slide thereagainst.

5 Claims, 3 Drawing Sheets

COMPRESSION SOCK AID

CROSS REFERENCE TO RELATED APPLICATION

This application claims the benefit of U.S. Provisional Application No. 61/906,729 filed on Nov. 20, 2013 entitled "Compression Sock Aid." The above identified patent application is herein incorporated by reference in its entirety to provide continuity of disclosure.

BACKGROUND OF THE INVENTION

1. Field of the Invention

The present invention relates to a device for easily applying a compression stocking or sock to the calf and leg of the user. More specifically, the present invention pertains to a compression sock aid donning device that comprises a double paneled structure connected via a hinge, wherein each panel of the double paneled structure provides two connected panels to which the device further includes a spring member, handles, friction pads, thumb grips, gripping portions, a hook notch and a ball fastening closure mechanism.

Compression stockings and socks are specialized elastic types of hosiery that are designed to treat and prevent the occurrence of venous and other circulation disorders such as varicose veins, edema, phlebitis, lymphedema, deep vein thrombosis and the like. Such stockings and socks are intended to apply a substantial amount of pressure onto the legs of the wearer in order to increase the arterial pressure of the legs, thus causing a greater circulation of blood to the heart and greater overall circulation for the wearer. It can be quite an arduous task to apply these tight fitting socks and stockings over the foot, calves and legs of the wearer, and it can be especially difficult for the handicapped, elderly and those with limited physical abilities.

Many hosiery donning devices relate to apparatuses for applying a stocking that have loops, straps and belts through which a user can attach the straps to the hosiery and pull on the hosiery without assistance from another, and without having to bend over. Such devices are of poor construction and lack a strong and sturdy structure needed for applying tight fitting hosiery and as such, these devices can easily slip from the stocking and the user's hands More practical methods of applying hosiery provide a trough device wherein the user can place the stocking over the trough and apply the stocking to the foot and calf of the user with relatively little bending over. However, such devices do not offer a spring induced tension that allows the user to further expand the diameter of the stocking to more easily apply the stocking thereon. These described devices cause the user to exert much energy and struggle with applying the tight fitting hosiery onto the foot, calves and legs, and further to fit the tight fitting hosiery item to the device itself.

Accordingly, the present invention relates to a new and improved hosiery donning device, wherein the device enables the user to easily apply compression hosiery over the foot, calf, and leg of the user by expanding the hosiery item prior to application thereover. Specifically, the present invention provides a double paneled structure that is hingedly connected and spring biased to create a tensioned resistance that opens and closes the panels of the device. This enables the panels to be inserted into a compression hosiery item in a more collapsed state, and thereafter opened to a larger diameter prior to application of the hosiery item over the user's foot and calf.

2. Description of the Prior Art

Devices have been disclosed in the prior art that relate to hosiery donning devices. These include devices that have been patented and published in patent application publications. These devices generally relate to apparatuses used for applying hosiery, stockings and other like garments to one's foot and calf thereon. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 129,175 to Ettssell describes a strap having a hook at each end that can engage boot tugs of a boot wherein the strap is passed through the hook and attached to a slip buckle wherein the device can be passed behind the buttocks of the user in order to aid the user in drawing a boot on and up the leg of the user. However, this device provides little help for the placement of a compression stocking onto the leg of a wearer as compression stockings and socks do not provide boot tugs for attachment thereto.

U.S. Pat. No. 3,401,856 to Berlin discloses a hosiery donning device comprising a relatively stiff elongate upwardly opening trough having at least one end open and adapted to receive the foot of a user therein that includes a handle means extending from one end of the trough for grasping by a user, whereby an article of hosiery can be placed over one end of the trough device. The user can place his or her foot onto the open end of the trough and can manually withdrawal the trough to pass the foot through and into the hosiery article. While this may be a helpful method, the described handle means comprises a quick releasable attachment that may prove to easily detach and thus offers a weak handle means on which to firmly and strong pull thereon.

U.S. Pat. No. 3,310,209 to Clauss describes a device directed to assisting in the putting on of stockings and the like and is directed to an improved and simplified device for facilitating the putting on of stockings by invalids or those who are handicapped and unable to bend the legs or body to the extent necessary to put on stockings in the usual manner. The device comprises a pan-like slide member having a flexible strap attached at one end. The present invention however, provides a two paneled structure connected by a hinge wherein the two panels can be opened and closed via a spring member.

U.S. Pat. No. 2,828,057 to Maclauchlan provides a device for putting on stockings that comprises a pair of wooden handles connected to members that provide a foot shaped base member in which the foot of a user can be placed therein and a stocking can be placed over the foot shaped base member. The structure of this device however, makes it quite difficult to extend a stocking all the way up the calf of the user since it only provides a foot shaped base member. The present invention provides a tube shaped structure that conforms to the typical leg calf shape that can enable the user to place a compression stocking onto the foot and extend it up the calf of the user thereon.

U.S. Pat. No. 5,799,844 to James discloses a sock aid for enabling the pulling on of a sock onto a foot, and comprising a wire frame having a U-shaped heel portion part of the aid and a pulling strap secured to the heel portion wherein the user can place a sock on the end of the device and place his or her foot into the heel portion and pull the strap in order to place the sock onto the user's foot. This device however is helpful for standard socks and offers little utility in the way of compression stocking and sock applications.

U.S. Pat. No. 7,234,616 to Thom provides a hosiery donning aid apparatus that comprises a body formed as a channel having interior and exterior surfaces and two outer edges wherein the device offers a frictional arrangement consisting of a multiplicity of frictional ribs. This device however, does not provide a hinge in order to further aid the user in expanding the diameter of the hosiery in order to insert his or her foot and leg therein.

U.S. Pat. No. 2,796,207 to Alma describes a guide device for facilitating the putting on of a stocking by which the user may put on stockings without bending over, and without assistance by another person. The device includes a connector such as a hose supporter for detachably connecting to the guide a stocking and a strap to furnish an upwardly extending grasping portion while operating the guide. The present invention provides handles and friction pads in order to easily apply tight-fitting compression stockings onto the legs of the wearer.

These prior art devices have several known drawbacks. The above discussed hosiery donning devices are not specifically intended for use with compression stockings or socks and do not include the necessary elements that are commensurate with such a purpose. The above discussed devices do not provide a compression sock or stocking aid with handles, a spring mechanism, gripping portions, closure means, thumb grips, friction pads, a calf conforming structure and a hinge mechanism to allow for adjustability thereto.

The present invention substantially diverges in design elements from the prior art and consequently it is clear that there is a need in the art for an improvement to existing hosiery donning and compression sock aid devices. In this regard the instant invention substantially fulfills these needs.

SUMMARY OF THE INVENTION

In view of the foregoing disadvantages inherent in the known types of hosiery donning devices now present in the prior art, the present invention provides a new compression sock aid device that provides a hinge, handles, closure means, gripping portions, friction pads, thumb grips and a spring member wherein the same can be utilized for providing convenience for the user when applying compression stockings, socks or other tight-fitting hosiery onto the foot, calves and legs of the wearer.

It is therefore an object of the present invention to provide a new and improved compression sock aid and hosiery donning device that has all of the advantages of the prior art and none of the disadvantages.

It is another object of the present invention to provide a compression sock aid with a hinged structure.

Another object of the present invention is to provide a compression sock aid with a spring member.

Another object of the present invention is to provide a compression sock aid with thumb grips.

Another object of the present invention is to provide a compression sock aid with friction pads to prevent the slipping of the hosiery from the invention.

Another object of the present invention is to provide a compression sock aid with a closure means to allow a compression sock or stocking to be placed on the invention.

Another object of the present invention is to provide a compression sock aid with gripping portions to prevent the handles from sliding out of the user's hands while pulling the handles upward to release the device from the compression sock or hosiery.

Another object of the present invention is to provide a hinge terminating in a v-shaped structure to conform to the natural shape of a user's calf.

Another object of the present invention is to provide a compression sock aid with handles to release the invention from a compression sock or other hosiery.

Yet another object of the present invention is to provide a compression sock aid with a hook notch in which the fastening ball can be placed therein and rest thereagainst to maintain the invention in a closed position.

Yet another object of the present invention is to provide a compression sock aid an outwardly extending lip to allow the user to grip thereon when lifting the device upward and out of the compression sock or hosiery.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
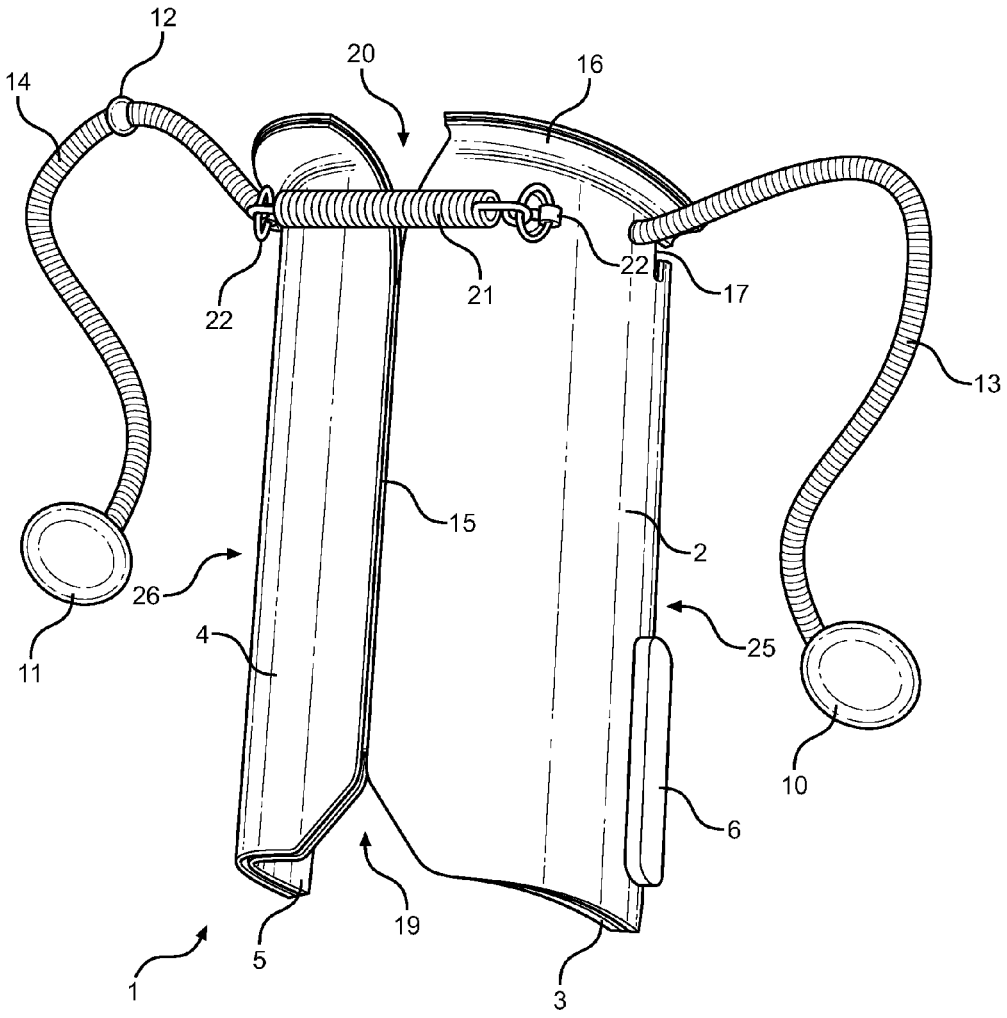
FIG. 1 shows a back exterior view of the compression sock aid device having a hinged double paneled structure wherein the spring member, friction pad, handles, fastening ball, V-shaped structure and outwardly extending upper lip are shown.

Reference is made herein to the attached drawings. Like reference numerals are used throughout the drawings to depict like or similar elements of the compression sock aid device. For the purposes of presenting a brief and clear description of the present invention, the preferred embodiment will be discussed as used for applying compression socks, stockings or other hosiery onto the foot, calves and legs of the user. The figures are intended for representative purposes only and should not be considered to be limiting in any respect.

Figure 3:
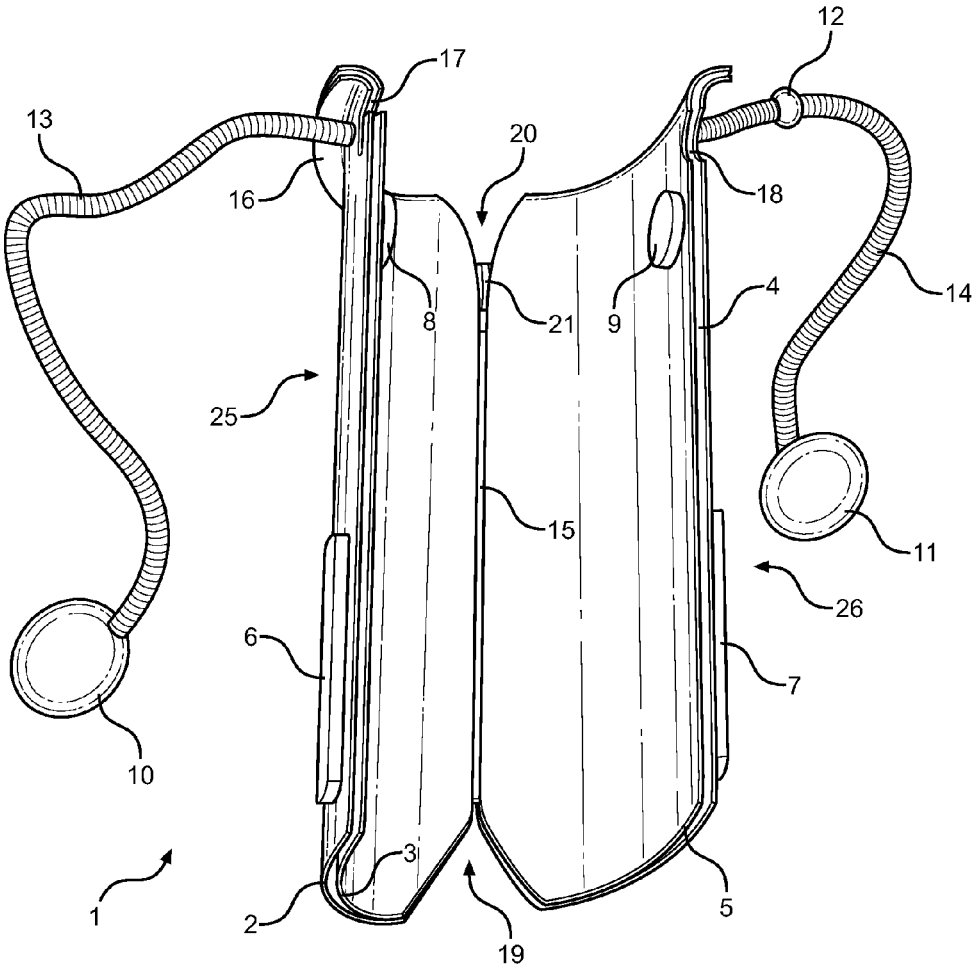
FIG. 3 shows a front interior view of the compression sock aid device having a hinged double panel structure wherein the handles, gripping portions, thumb grips, friction pads, fastening ball and outwardly extending upper lip are shown.

Referring now to FIG. 1, there is shown a back exterior view of the compression sock aid device. The device provides a two paneled structure having a left panel structure 25 and a right panel structure 26 that are connected via a hinge 15 and a spring mechanism 21 wherein each left and right panel structure 25, 26 comprises a double paneled structure that includes exterior panels 2, 4 and interior panels 3, 5. Each left and right exterior 2, 4 and interior panels 3, 5 provides a top portion, a bottom portion, a bottom edge, a top edge and an interior edge and an exterior edge wherein the top portion of each left and right interior panel 3, 5 includes small circular thumb grips 8, 9 as shown in FIG. 3 located closest to the exterior edge of each left and right interior panel 3, 5.

The bottom interior edge of both the left and right interior and exterior panels 2, 4, 3, 5 provide an angled structure wherein the hinge 15 terminates in a v-shaped structure 19 thus forming a v-shaped cutout 19 at the bottom interior edge therein. The v-shaped cutouts 20, 19 are arranged as such in order to provide a structure that is conducive to the shape of a calf that can readily conform to the calf without pinching or catching the skin when applied thereto.

The top interior edge of both the left and right interior panels 3, 5 and exterior panels 2, 4 provide an angled structure 20 wherein the hinge 15 terminates in a v-shape thus forming a v-shaped cutout 20 at the top interior edge therein. The top edge of both the left and right interior and exterior panels 2, 4, 3, 5 form an outwardly extending upper lip area 16 in order to facilitate the application to and removal of the device from the calf of the user wherein the user can manually grip the outwardly extending upper lip area in order to release the device from the leg of the user and the compression sock or other hosiery thereon.

Both the right end left exterior panels 2, 4 provide a rope handle 13, 14 that extends from the left and right exterior panels 2, 4 therefrom and is formed as a braided rope 13, 14 in a preferred embodiment as shown, with a gripping apparatus 10, 11 attached at the end of the rope handles 13, 14 thereto. The rope handle 14 provided by the right exterior panel 4 includes a small fastening ball 12 located near the top portion of the rope handle 14 and attached thereto. The top portion of the right exterior 4 and right interior panel 5 provide a small notch 18 as shown in FIG. 3, located along the exterior edge wherein both the left exterior 2 and left interior panel 3 provide a hook notch 17 wherein the small fastening ball 12 of the right rope handle 14 can be manually placed into the hook notch 17 and secured therein thus comprising the closure means of the compression sock aid device 1.

Figure 2:
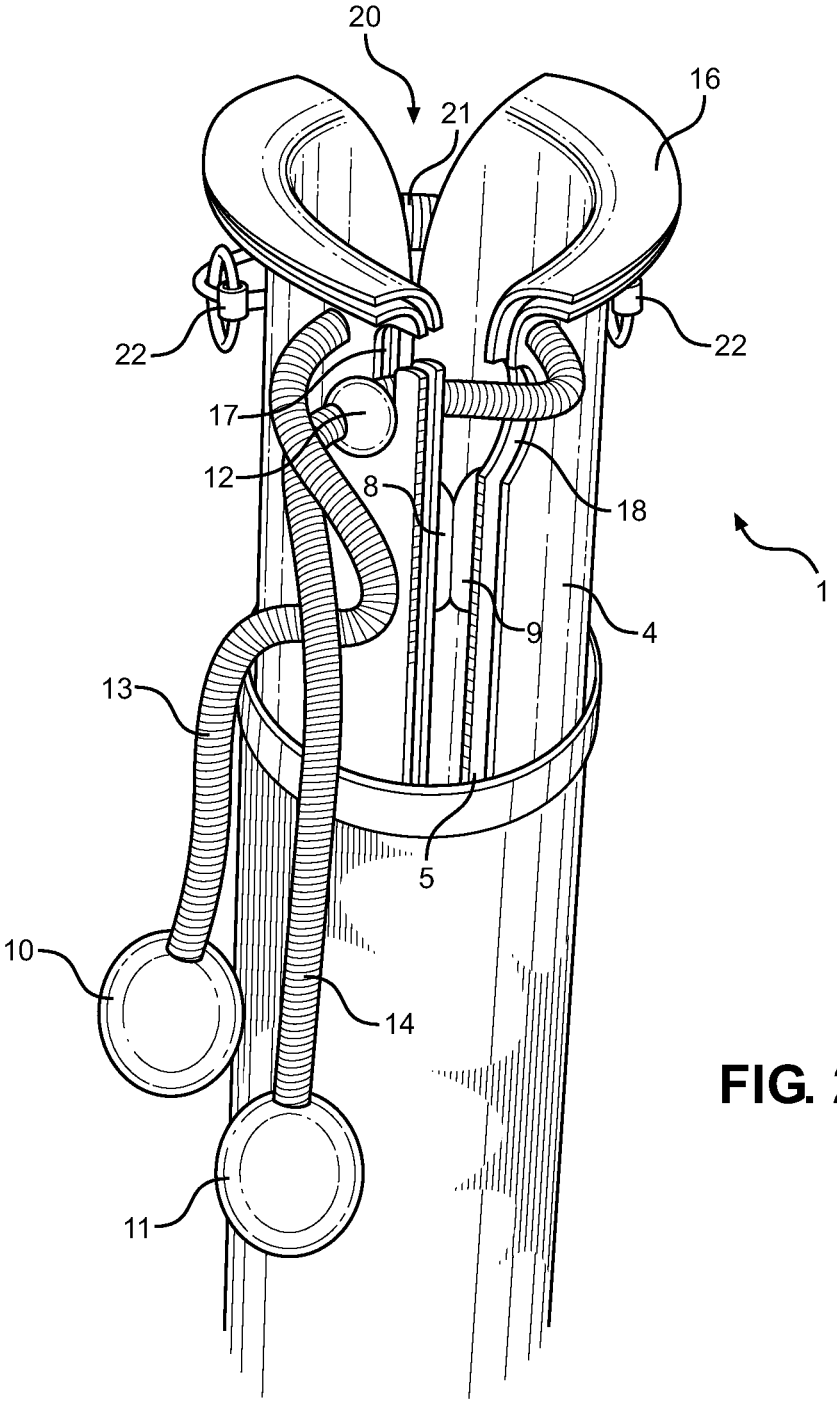
FIG. 2 shows a view of the compression sock aid device in a closed position with a compression sock garment placed thereon.

Referring now to FIG. 2, there is shown a view of the compression sock aid 1 in a closed position wherein a compression sock is placed thereon. The compression sock aid structure 1 provides a spring mechanism also known as a spring member 21 that is affixed to the top portion of the left and right exterior panels 2, 4 wherein the spring mechanism connection means can be accomplished via d-rings 22 as shown in a preferred embodiment, or can be bolts, screws, or other types of suitable fastening means. The spring member 21 provides a tension that enables the user to move the compression sock aid device 1 in an open and closed position and varying degree positions thereinbetween in which the spring mechanism 21 can be a helical spring, coil spring, torsion spring, compression spring, tension/extension spring or any other type of suitable spring mechanism device.

The user can place his or her left and right thumbs onto the left and right thumb grips 8, 9 of the left and right interior panels 3, 5 and place his or her fingers over and grip the outwardly extending upper lip 16 or the left and right panel structure 25, 26 wherein the user can manually adjust the compression sock aid device into a closed position via slipping the rope handle 14 of the right exterior panel 4 into the hook notch 17 in order to secure lock the device in a closed position. The tension created by the spring mechanism 21 provides a pressure applied against the fastening ball 12 that locks the device in a closed position wherein the user can then place a compression stocking, sock or other hosiery onto the bottom portion of the compression sock aide device and extend the stocking or sock upward to the top portion to which the user can open the device via removing the rope handle 14 and fastening ball 12 of the right exterior panel 4. The opening of the device with the compression sock thereon thus expands the diameter of the compressions sock thereon allowing a large opening in the sock to be made for the insertion of the user's foot and calf into the compression sock to which the user can then pull the handles in an upward direction up the leg 13, 14 without having to bend over and can slide the device out of the compression sock therefrom via gripping the outwardly extending lip 16 in order to remove the device from the sock. When the user pulls the handles 13, 14 in an upward direction, the gripping portions 10, 11 prevent the user's hand from slipping from the handles therefrom and allow the user to easily pull the handles 13, 14.

The removal of the right exterior panel 4 rope handle 14 and fastening ball 12 from the hook notch 17 as described above allows the compression sock aid device 1 to expand in an open position thus greatly increasing the diameter of the stocking, sock, or other hosiery applied thereon wherein the user can insert their foot therein in order to apply the compression stockings or sock to the foot, calf and leg thereon to which the user can grasp the left and right rope handles 13, 14 in order to slide the compression sock aid device from the interior area of the compression stockings, sock or other hosiery therefrom.

Gripping portions 10, 11 are located at the bottom end of the left and right rope handles 13, 14 in order to allow for the removal of the compression sock aid device from the compression stockings or other hosiery in which it is contained therein without allowing the hand to readily slip from the rope handles 13, 14 therefrom wherein the gripping portions 10, 11 are spherical balls in a preferred embodiment as shown and provide a stop mechanism for the user's hands upon contact therewith thus allowing the user to maintain a firm and stable grip onto the rope handles 13, 14.

The left and right exterior panels 2, 4 contain friction pads 6, 7 that are located along the exterior edge towards the bottom portion of the left and right exterior panels 2, 4 thereon. The friction pads 6, 7 can be an elongated strip that is rectangular in shape in a preferred embodiment as shown, wherein the friction pads 6,7 allow the compression stocking or sock placed on the compression sock aid device to securely adhere to the device without slipping or sliding therefrom. The friction pads can be circular, square or any other shape and are not limited to the shaped described above wherein there can be a plurality of friction pads in another embodiment located on the exterior surface of the left and right exterior panels 2, 4 thereon.

Referring now to FIG. 3, there is shown a front interior view of the compression sock aid device. The back side of the left interior panel 3 and the front side of the left exterior panel 2 are connected to one another via fastening means that can include adhesives, heat sealing means, rivets, pins, plastic fasteners or any other type of suitable bonding means wherein the left interior panel 3 and the left exterior panel 2, once fixed to one another, form a unitary structure comprising the left panel structure 25 of the compression sock aid device 1. Similarly, the back side of the right interior panel 5 and the front side of the right exterior panel 4 are connected to one another via fastening means that can include adhesives, heat sealing means, rivets, pins, plastic fasteners or any other type of suitable binding means wherein the right interior panel 5 and the right exterior panel 4, once fixed to one another, form a unitary structure comprising the right panel structure 26 of the compression sock aid device 1.

The left and right panel structures 25, 26 are connected to one another via a hinge structure 15 wherein the connection means can include, but are not limited to rivets, bolts, screws, sewing means, pins or any other type of suitable fastening means wherein the connection of the left panel structure 25 and right panel structure 26 extend along the hinge 15 and terminate in a v-shaped structure 19, 20 also known as a v-shaped cutout at the top and bottom of the compression sock aid device 1. The rope handles 13, 14 are connected to the left and right exterior panels 2, 4 and in a preferred embodiment can be connected via tying the rope handle into a knot to the left and right exterior panels thereto. In another embodiment, the rope handles 13, 14 can be affixed to the left and right exterior panels 2, 4 via various fastening means that can include adhesives, screws, bolts, pins and other suitable fastening means thereof. The handles 13, 14 of the compression sock aid device 1 are not limited to the aforementioned rope structure handle wherein the handles 13, 14 of the compression sock aid device can be straps, belts, chains, braids and/or any other suitable handle structure.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A compression sock aid device, comprising:

a left exterior panel, said left exterior panel having a top, bottom, interior edge, exterior edge, and a front side and a back side;

a right exterior panel, said right exterior panel having a top, bottom, interior edge, exterior edge and a front side and a back side;

a left interior panel, said left interior panel having a top, bottom, interior edge, exterior edge, and a front side and a back side;

a right interior panel, said right interior panel having a top, bottom, interior edge, exterior edge, and a front side and a back side;

said left exterior panel and said right exterior panel comprise rope handles, said rope handles having a top end and a bottom end, said bottom end of said rope handles further comprising a ball shaped gripping portion;

at least one of said rope handles comprising a fastening ball, wherein said fastening ball is adapted to be placed within said hook notch;

said exterior edge of said left exterior panel and said left interior panel comprising a hook notch;

said exterior edge of said right exterior panel and said left interior panel comprising a hook notch;

said back side of said left interior panel being affixed to said front side of said left exterior panel forming a left panel structure;

said back side of said right interior panel being affixed to said front side of said right exterior panel forming a right panel structure;

wherein said left panel structure is connected to said right panel structure via a hinged connection;

said left panel structure and right panel structure further comprising a spring member therebetween wherein said spring member is connected to said exterior left panel and said exterior right panel to bias the left panel structure and right panel structure apart from one another.

2. The compression sock aid device of claim 1, wherein said interior edges of said left exterior panel, left interior panel, right exterior panel, and said left interior panel form a V-shape cutout above and below said hinged connection.

3. The compression sock aid device of claim 1, wherein said left exterior panel and said right exterior panel further comprise friction pads along their exterior edges.

4. The compression sock aid device of claim 1, wherein said top of said left interior panel and said top of said right interior panel comprise thumb grips.

5. The compression sock aid device of claim 1, wherein:

said top of said left exterior panel having an outwardly extending upper lip structure;

said top of said right exterior panel having an outwardly extending upper lip structure;

said top of said left interior panel having an outwardly extending upper lip structure;

said top of said right interior panel having an outwardly extending upper lip structure.

* * * * *